US008726922B2

(12) United States Patent
Pak et al.

(10) Patent No.: US 8,726,922 B2
(45) Date of Patent: May 20, 2014

(54) SYSTEM AND METHOD FOR ARTICULATING WALKING AID

(76) Inventors: Amie Pak, Denver, CO (US); Sally Jane Lyons, Littleton, CO (US)

( * ) Notice: Subject to any disclaimer, the term of this patent is extended or adjusted under 35 U.S.C. 154(b) by 0 days.

(21) Appl. No.: 13/525,535

(22) Filed: Jun. 18, 2012

(65) Prior Publication Data

US 2013/0334784 A1 Dec. 19, 2013

(51) Int. Cl.
*A61H 3/00* (2006.01)
*A61H 3/04* (2006.01)

(52) U.S. Cl.
USPC ..... 135/67

(58) Field of Classification Search
USPC ..... 135/67
See application file for complete search history.

(56) References Cited

U.S. PATENT DOCUMENTS

| | | | | |
|---|---|---|---|---|
| 2,796,916 | A | 6/1957 | Womble | |
| 3,098,651 | A * | 7/1963 | Murcott | 482/66 |
| 3,442,276 | A * | 5/1969 | Thomas et al. | 135/67 |
| 4,452,484 | A | 6/1984 | Pastor | |
| 4,800,911 | A | 1/1989 | Endres et al. | |
| 5,305,773 | A | 4/1994 | Browning | |
| 5,347,666 | A * | 9/1994 | Kippes | 5/81.1 R |
| 5,465,744 | A | 11/1995 | Browning | |
| 5,467,793 | A | 11/1995 | Hart | |
| 5,499,856 | A | 3/1996 | Sorrell et al. | |
| 5,509,152 | A * | 4/1996 | Kippes | 5/81.1 R |
| 6,338,354 | B1 | 1/2002 | Alexander | |
| 7,278,436 | B2 * | 10/2007 | Gale et al. | 135/74 |
| 7,637,274 | B1 | 12/2009 | Dodson | |
| 7,963,294 | B1 | 6/2011 | Trout | |
| 8,251,079 | B1 * | 8/2012 | Lutz et al. | 135/67 |
| 2008/0029138 | A1 | 2/2008 | Foote | |

* cited by examiner

*Primary Examiner* — Noah Chandler Hawk
(74) *Attorney, Agent, or Firm* — Daniel W. Roberts; Law Offices of Daniel W. Roberts, LLC

(57) ABSTRACT

Provided is a system and method for an articulating walker. The system includes a generally vertical first support in a first plane and a generally vertical second support in a second plane generally parallel to the first plane. An interconnector is also provided and pivotally attached between the first support and the second support. An articulator is structured and arranged to maintain the generally parallel relationship between the first plane and the second plane as the first support and the second support move relative to each other about the interconnector. An associated method of use for providing a normal walking motion is also provided.

21 Claims, 11 Drawing Sheets

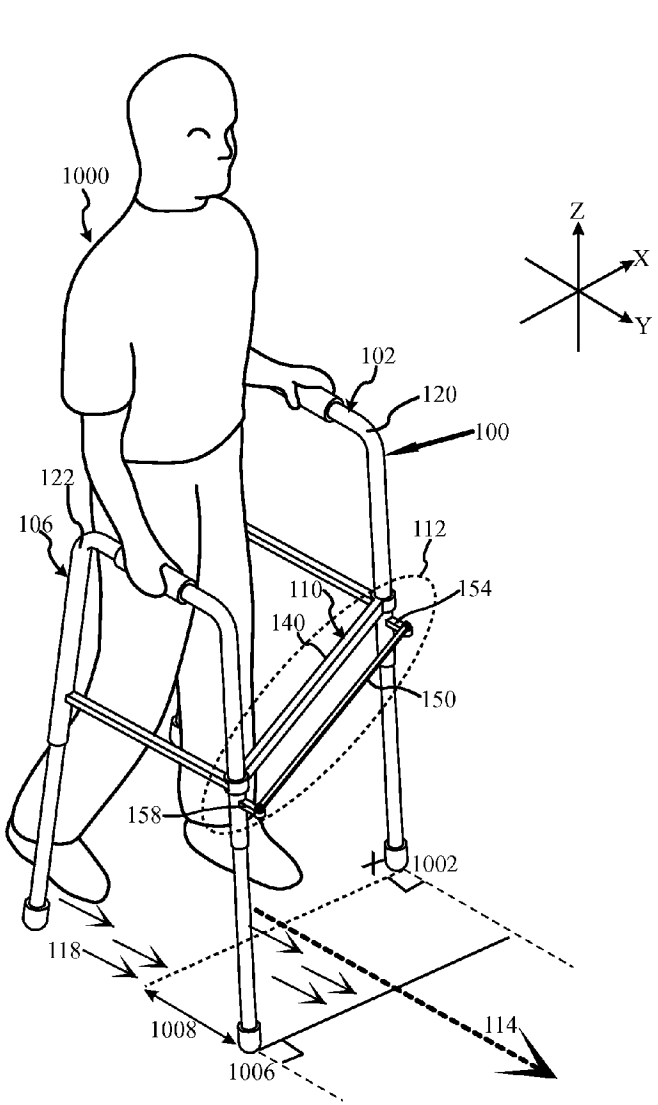
FIG. 10
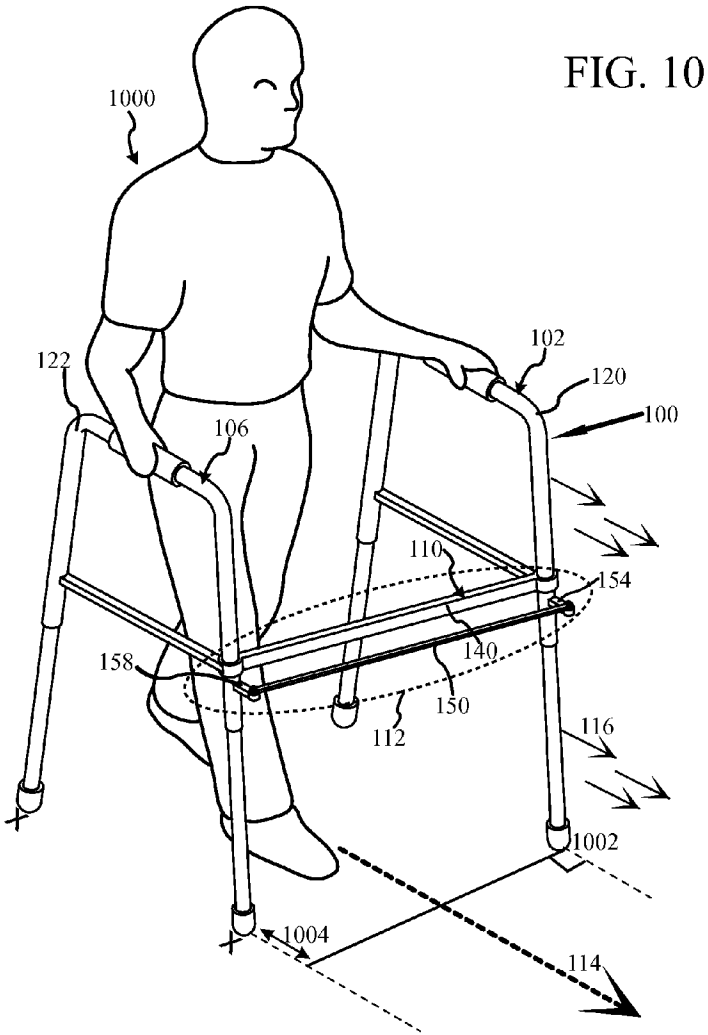

SYSTEM AND METHOD FOR ARTICULATING WALKING AID

CROSS-REFERENCE TO RELATED APPLICATIONS

None.

FIELD OF THE INVENTION

The present invention relates generally to systems and methods for assistance in walking, and more specifically to systems and methods for assistance and support in the act of walking that generally coincides with the natural articulation of a human being while walking.

BACKGROUND

For human beings, ambulation—also known as walking, is perhaps the most fundamental form of locomotion. Walking is also considered to have significant health benefits and so whether young or old there is a general view among the medical community that walking for thirty to sixty minutes a day with correct posture reduces a variety of health risks which may include heart disease, anxiety, depression, obesity, high blood pressure, type 2 diabetes, cancer and many other ailments.

Human walking may be generally described as the motion of an inverted pendulum, in which the upper body is vaulted over the stiff lower limb, i.e., leg, that has been placed in contact with the ground. As this vault is performed the next leg is brought into contact with the ground, a weight transfer is performed and again the upper body is vaulted forward.

It is also quite common for the arms to be employed in the process of walking, as they can assist in balancing the body as weight is shifted from one leg to the next. In most instances the motion of the arms is to counter balance—which is to say that as a person's left leg moves forward so, too, does his right arm. Then, as the right leg moves forward past the supporting left leg, the left arm also moves forward. In some situations, rather than the counter balancing (asynchronous) motion, a person may opt to use his or her arms in a synchronous motion—moving the left arm and left leg together and then the right arm and right leg together.

At some points in the lives of some people, such as in the case of injury, illness, age or other event, the ability to walk may become difficult if not otherwise impossible. For some, the only option for mobility may be a wheelchair whether self-propelled or driven by the person's hands and arms.

But when and where possible, the benefits of walking as well as the drive of a person's self esteem and desire for independence typically lead the person and his or her family, friends and doctors to encourage walking with the use of a physical aid. For some, a cane or staff may be sufficient, but in many cases a walking aid that is truly capable of safely supporting the person's weight is necessary.

Crutches are also well known and in general are used to permit a user to elevate one foot during movement from one site to another, but are generally not considered a tool for typical walking because of the continued elevation of a foot during use.

In some cases, during rehabilitation a set of parallel bars are used to permit a person to support him or herself by the arms as he or she moves his or her feet forward along the length of the parallel bars. Arm motion, whether synchronous or asynchronous with foot motion is not inhibited, and for the limited length of the parallel bars the person enjoys an opportunity for assisted walking that is fairly natural.

Of course, parallel bars are large, long, heavy and stationary. Beneficial though they may be in terms of therapy and retraining walking ability, they are not functional as a part of daily life.

Devices known as "walkers" are therefore typically employed for use in day-to-day adventures of getting around in a sort of walking fashion. In general, walkers are comprised of a framed structure providing a left and right side that are spaced apart and rigidly joined. Many walkers may be described as being generally U-shaped when viewed from above, as the left side, right side and front section define a three-sided space for supporting a user within its boundaries. The sides and front are typically braced in some manner, such that the device can be free standing, and more importantly, so that when in use the sides will not collapse inwardly or outwardly—an event that would most likely destabilize the user and possibly lead to a fall and perhaps even injury.

The use of a walker is typically employed in one of two ways—the first is for the user to pick up the walker and move it some distance ahead of himself or herself, and then while holding it with his or her hands, to walk, ambulate or shuffle forward. Then, the walker is again picked up and moved, rolled or scooted forward for the process to repeat. The second general option is for the user to scoot the walker over the ground with himself or herself as he or she walk or shuffle forward. And, of course, combinations of picking up, scooting, shoving and or sliding the walker may be performed at different times and in different ways.

Moreover, the walker device is in general a movable platform that provides ridged support to the user as he or she moves forward and/or leans left or right. One example is Walker U.S. Pat. No. 4,452,484 to Pastor, which has two essentially horizontal frame members 12 with legs 14, 16 and upper and lower support rods 22, 24 disposed between the legs 14 at the front of the walker 10. Pastor also provides a backrest 26 and a seat 48, but moreover the upper and lower support rods rigidly brace the left and right sides.

Another is Walker Carrier U.S. Pat. No. 4,800,911 to Endress et al., which again has opposing leg members 12 and 14 separated to form a space in which the user may position his or her body when standing. The front of the walker is closed with brace members 15 and 30 extending between the respective leg members to which they are secured for structurally stabilizing the walker.

Further examples can be found with the Mobility Assist Devices of U.S. Pat. Nos. 5,465,744 and 5,305,773 to Browning as well as the Sliding Tray Assembly walker device of U.S. Pat. No. 5,170,810 to Chapin—each providing a rigid frame to define an area in which the user should stand.

However, it has also been realized that a walker when not in use can be difficult to store and/or transport. Accordingly, some walking aid devices have been developed that permit firm support for active use, but which also can be folded for transportation and storage. One such device is the Folding Walking Aid of U.S. Pat. No. 2,799,916 to Womble, and another is the Collapsible Power Gait Walker of U.S. Pat. No. 6,338,354 to Alexander.

In Womble, two identical frames 1 and 2 are pivotally related by generally parallel sleeves 13 and 14 interconnected in a spaced relation by tubular transverse arched struts 15 and 16. A pair of releasable locks are provided, such that the frames may be releasably held in either an extended position as shown in FIG. 1 for use in walking, or a folded position as indicated by the dotted lines of FIG. 4 wherein the frames are folded inwardly to lie against the arched struts 15 and 16.

With respect to Womble, when the releasable locks are not engaged each frame 1 and 2 may rotate freely—outwardly or inwardly and with no coordinated relation to one another, such that reliable support is not ensured.

In Alexander, the walker 11 is constructed from a left side frame 13, a right side frame 15 and a rear crossbar 17 that is pivotally connected to and between the left side frame 14 and the right side frame 16. Hinge tubes 91 are taught to achieve the pivotal connections and each has a pair of buttonholes 93 and 95 set to receive a spring-loaded button when each respective frame is at a predetermined angle—e.g., folded for storage or out for use. Alexander does note that by adjusting the height of the crossbar, the user may avoid the locking buttons entering the button-holes to allow both side frames to freely pivot. Moreover, each frame side may rotate freely—outwardly or inwardly and with no coordinated relationship to one another, such that reliable support is not ensured.

Moreover, the traditional walkers such as those presented by Pastor, Endress, Browning and Chapin are traditional frame structures which do not accommodate the natural articulating motion of arms and legs. As such, any assistance in the prospect of walking is actually provided in a form that is contrary to the natural style desired by the biomechanics of the body in motion. Womble and Alexander provide alternative walker arrangements principally directed toward ease of storage or transport, but in so doing they can permit independent movement of the walker's frame components.

However, both Womble and Alexander fail to provide any interrelationship between the movements of the left and right sides and this failing is extreme. Moreover, with respect to the walker devices as taught by Womble and Alexander, when the left and right side frames are released for rotation there is no safeguard, no assurance that one or both sides will not be over-rotated such that the walker may become unstable and collapse to detriment of the using person. Indeed, when the sides are unlocked the structural stability of the walker—a key point noted by Endress—is all but uncertain. There is also no assistance provided to the user to experience assisted articulation.

Hence there is a need for a system and method for an articulating walker that is capable of overcoming one or more of the above identified challenges.

SUMMARY

Embodiments of this invention provide a system and method for an articulating walking aid, and more specifically to systems and methods for providing support and permitting a normal walking motion to a person using an articulating walker.

In particular, and by way of example only, according to one embodiment of the present invention, provided is an articulating walker, including: a generally vertical first support; a generally vertical second support generally parallel to the first support; an interconnector pivotally attached between the first support and the second support; and an articulator structured and arranged to maintain the generally parallel relationship between the first support and the second support as the first support and second support move relative to each other about the interconnector.

For another embodiment, provided is an articulating walker, including: a generally vertical first support in a first plane; a generally vertical second support in a second plane generally parallel to the first plane; an interconnector pivotally attached between the first support and the second support; and an articulator structured and arranged to maintain the generally parallel relationship between the first plane and the second plane as the first support and second support move relative to each other about the interconnector.

In another embodiment, provided is an articulating walker, including: a left side frame; a right side frame; a crossbar having a first end pivotally connected to the left side frame and a second end pivotally connected to the right side frame; and an articulator structured and arranged to maintain about a parallel relationship between the left side frame and the right side frame as they articulate about the crossbar.

In yet another embodiment, provided is a method of providing support and permitting a normal walking motion to a person including: providing an articulating walker comprising; a left side frame; a right side frame; a crossbar having a first end pivotally connected to the left side frame and a second end pivotally connected to the right side frame; and an articulator structured and arranged to maintain about a parallel relationship between the left side frame and the right side frame as they articulate about the crossbar; advancing the left side frame over a surface relative to the stationary right side frame, the person maintaining support on the right side frame; and advancing the right side frame over the surface relative to the stationary left side frame, the person maintaining support on the left side frame.

BRIEF DESCRIPTION OF THE DRAWINGS

At least one system and method for an articulating walking aid will be described, by way of example in the detailed description below with particular reference to the accompanying drawings in which like numerals refer to like elements, and:

FIG. 10 is a perspective view of a person using an articulating walker in accordance with certain embodiments of the present invention.

DETAILED DESCRIPTION

Before proceeding with the detailed description, it is to be appreciated that the present teaching is by way of example only, not by limitation. The concepts herein are not limited to use or application with a specific system or method for an articulating walking aid. Thus, although the instrumentalities described herein are for the convenience of explanation shown and described with respect to exemplary embodiments, it will be understood and appreciated that the principles herein may be applied equally in other types of systems and methods for an articulating walking aid or similar device.

Figure 1:
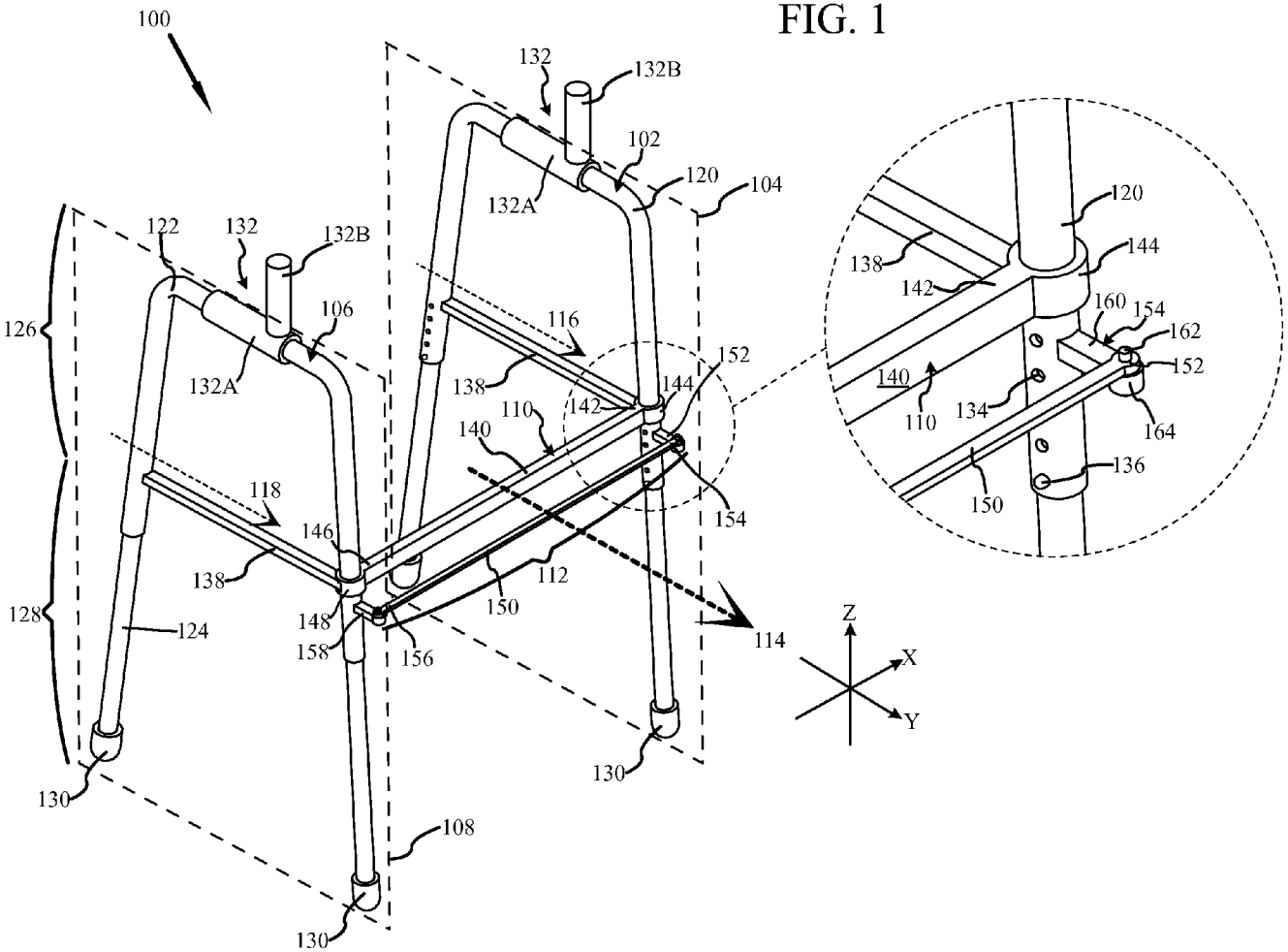
FIG. 1 is a perspective view of an articulating walker in accordance with certain embodiments of the present invention.

Turning now to the drawings, and more specifically FIG. 1, there is shown an articulating walker 100 according to at least one embodiment. To facilitate the description of articulating walker 100, the orientations of articulating walker 100 as presented in the figures are referenced to the coordinate system with three axis orthogonal to one another, as shown in FIG. 1

The axes intersect mutually at the origin of the coordinate system, which is chosen to be the center of the articulating walker 100, however the axes shown in all figures are offset from articulating walker 100 for ease and clarity of illustration. Moreover, FIG. 1 is a perspective view of articulating walker 100 in accordance with the X, Y and Z axis as shown.

Shown in FIG. 1, articulating walker 100 has a generally vertical first support 102 in a first plane 104 and a generally vertical second support 106 in a second plane 108 generally parallel to the first plane 104. At least one interconnector 110 is pivotally attached between the first support 102 and the second support 106, and an articulator 112 is structured and arranged to maintain the generally parallel relationship between the first plane 104 and the second plane 108, as the first support 102 and the second support 106 move relative to each other about the interconnector 110.

The articulator 112 is structured and arranged to achieve the symmetry of motion between the first support 102 and the second support 106. Moreover, the articulator 112 ensures at least in part that the articulating walker 100 maintains structural stability to support a user during use, and more specifically to encourage use by a person desiring coordinated use of his or her arms and legs during the process of walking.

Moreover, when in use by a user for the purpose of assisted walking, articulating walker 100 has an overall directional axis of motion 114, i.e., the primary motion 114. This primary motion 114 is understood and appreciated to be the forward motion of the user and the articulating walker 100 and for the sake of illustration and discussion is shown to correspond to the Y-axis. The first support 102 has a general first direction of motion 116 that is generally parallel to the primary motion 114. Likewise the second support 106 has a second direction of motion 118 that is generally parallel to the first direction of motion 116, and by consequence the primary motion 114 of the articulating walker 100.

It is also understood and appreciated that in various configurations and embodiments, the first support 102 and the second support 106 may in actuality be slanted towards one another as they rise from the ground. The general first plane 104 and second plane 108 which define the respective axis of motion 114 and 116 are still understood and appreciated to be parallel.

With respect to at least FIG. 1, for at least one embodiment, the first support 102 is a left side frame 120 and the second support 106 is a right side frame 122. For at least one embodiment, the right side frame 122 is substantially symmetrical to the left side frame 120. Further, the left side frame 120 and right side frame 122 are formed at least in part from hollow, light-weight cylindrical tubing 124 which is fashioned by bending, cutting and joining or other fabrication process into the shape generally as shown. Tubing 124 is made from aluminum or other metal alloys, plastics, composites or materials such that it is both lightweight and strong. In addition, tubing of various sizes may be employed.

Figure 6:
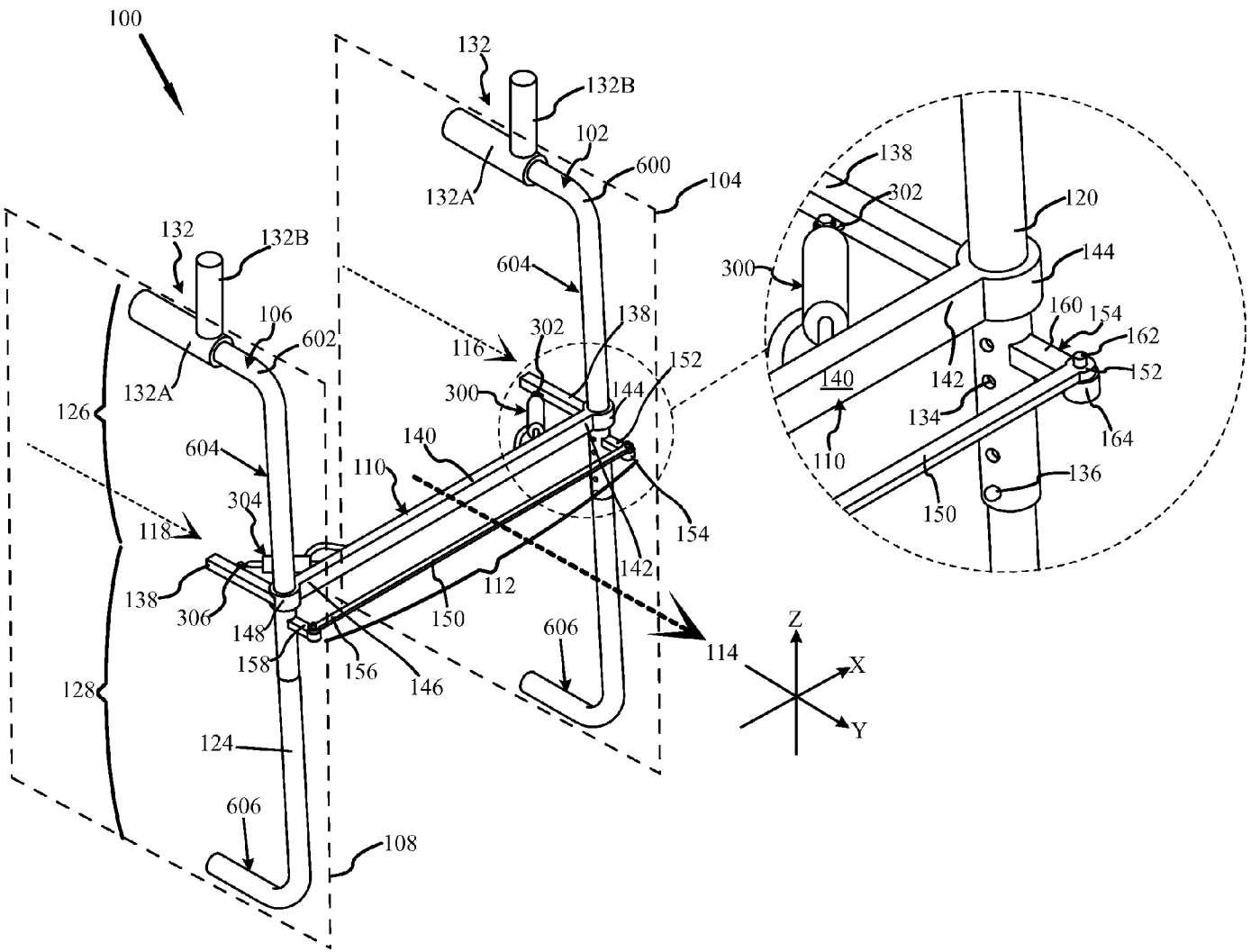
FIG. 6 is a perspective view of an articulating walker provided with yet another alternative articulator and each frame having a general L shape in accordance with certain embodiments of the present invention.
Figure 7:
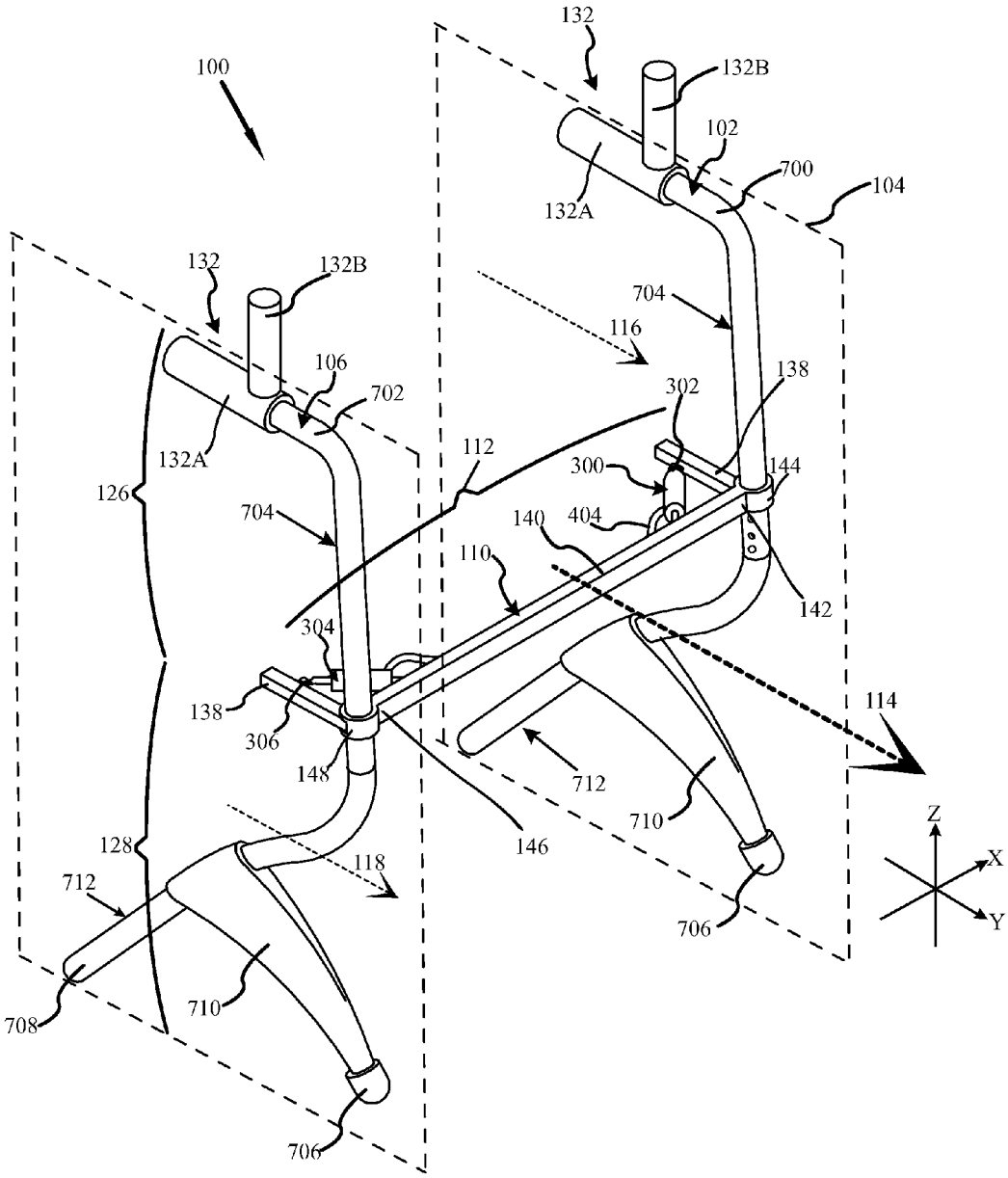
FIG. 7 is a perspective view of an articulating walker with each frame having a general inverted Y shape in accordance with certain embodiments of the present invention.

Moreover, for at least one embodiment, each frame 120, 122 is generally of an "A" shape configuration. As is shown in FIG. 6, for at least one embodiment, each frame 600, 602 is generally of an "L" configuration. And further, as shown in FIG. 7, for yet another embodiment, each frame 700, 702 is generally of an inverted "Y" shape.

Each side frame 120, 122 has an upper supporting section 126 and a base section 128, the upper supporting section 126 providing at least one grip 132 structured and arranged to allow a user to grasp the frame for assisted support when walking or standing. The base section 128 is structured and arranged for stable contact on a surface when the user is walking or standing.

With respect to at least FIG. 1 and the generalized "A" shape configuration, the legs of each "A" terminate as respective support ends 130 which provide supporting contact with the floor, ground or other surface. Support ends 130 may be capped with a rubber tip, cap, walker ski, tennis ball or other element to provide a non-slip surface for further stability. The top of each "A" provides at least one grip 132.

For at least one embodiment the grip 132 is a horizontal grip 132A to be grasped by the hand in a generally downward fashion. For at least one alternative embodiment, the grip 132 is a vertical grip 132B to be grasped by the hand in a generally forward fashion. As shown, for at least one embodiment, both a horizontal grip 132A and a vertical grip 132B are provided, permitting the user to selectively choose a different grip 132 depending on his or her comfort level or activity, e.g., the horizontal grip 132A for increased stability when rising, sitting or standing, and the vertical grip 132B for a more natural stance when walking.

Further, for at least one embodiment, each frame 120, 122 is structured and arranged to permit vertical height adjustment. For at least one embodiment, as in the generalized "A" shape configuration, such vertical height adjustment is achieved by configuring the legs of each "A" frame 120, 122 to be telescopically adjustable so as to be lengthened or shortened to adjust to the height of a user and provide the grips 132 at a comfortable elevation. As shown, for at least one embodiment, the telescopic adjustment is achieved for each leg by the use of regularly spaced buttonholes 134 set to receive a spring biased button 136. For at least one embodiment each buttonhole 134 is about 5/16 inches in diameter. In varying embodiments, each frame 120, 122 may have one or more braces, of which brace 138 is exemplary.

For at least one embodiment, the interconnector 110 is a crossbar 140. In varying embodiments, there may be multiple crossbars 140, however for ease of illustration and discussion a single crossbar 140 has been shown. Crossbar 140 has a first end 142 having a first pivot joint 144 connecting the first support 102 to the crossbar 140 and a second end 146 having a second pivot joint 148 connecting the second support 106 to the crossbar 140.

More specifically, the crossbar 140 is transverse to the first plane 104 and the second plane 108 and disposed between the first support 102 and the second support 106 and is structured and arranged to space them apart and permit at least some degree of pivoting rotation of both the first support 102 and the second support 106.

Moreover, the crossbar 140 has a first end 142 pivotally connected to the left side frame 120 and a second end 146 pivotally connected to the right side frame 122. For at least one embodiment the pivot connection is achieved by adapting each end of the crossbar to be a cylindrical hinge appropriately sized to have an inner diameter slightly larger than the outside diameter of the tubing 124 of each frame 120, 122. As shown, for at least one embodiment the cylindrical hinges are provided by joining a pair of vertical tube sections to the ends of the crossbar 140.

As noted above, articulating walker 100 is structured and arranged such the left side frame 120 and the right side frame 122 move in such a way as to maintain about a parallel relationship as they articulate about this crossbar 140. This symmetry of movement is advantageously achieved with an articulator 112. Articulator 112 may also be considered as a parallelizer—i.e., a device or combination of devises that are structured and arranged to maintain a general parallel relationship between the left side frame 120 and the right side frame 122 during use.

For at least one embodiment, the articulator 112 is achieved as a combination of elements including the crossbar 140. Moreover, as shown in FIG. 1 the articulator comprises a strut 150 that is parallel to and offset from the crossbar 140. Strut 150 has a first end 152 pivotally connected to a first mount 154 provided by the first support 102, i.e. left side frame 120, and a second end 156 pivotally connected to a second mount 158 provided by the second support 106, i.e., right side frame 122.

In varying embodiments, strut 150 may be a tube, rod, bar or other structure that is substantially ridged and which may be formed from generally the same material used in the fabrication of frames 120 and 122. Moreover in at least one embodiment strut 150 is metal and has about the same length as crossbar 140.

As is shown, first mount 154 is joined to the left side frame 120 and extends forward generally parallel to the Y-axis and first direction of motion 116. Likewise, second mount 158 is joined to the right side frame 122 and extends forward generally parallel to the Y-axis and second direction of motion 118.

Moreover, for the embodiment shown, each first mount 154 and second mount 158 is provided by a generally horizontal member 160 having a generally vertical pin 162 extending upward proximate to distal end 164. Vertical pin 162 is sized to mate with a hole in either the first end 152 or second end 156 of the strut 150 so as to provide the pivotal interconnection between strut 150, first mount 154 and second mount 158.

Figure 2:
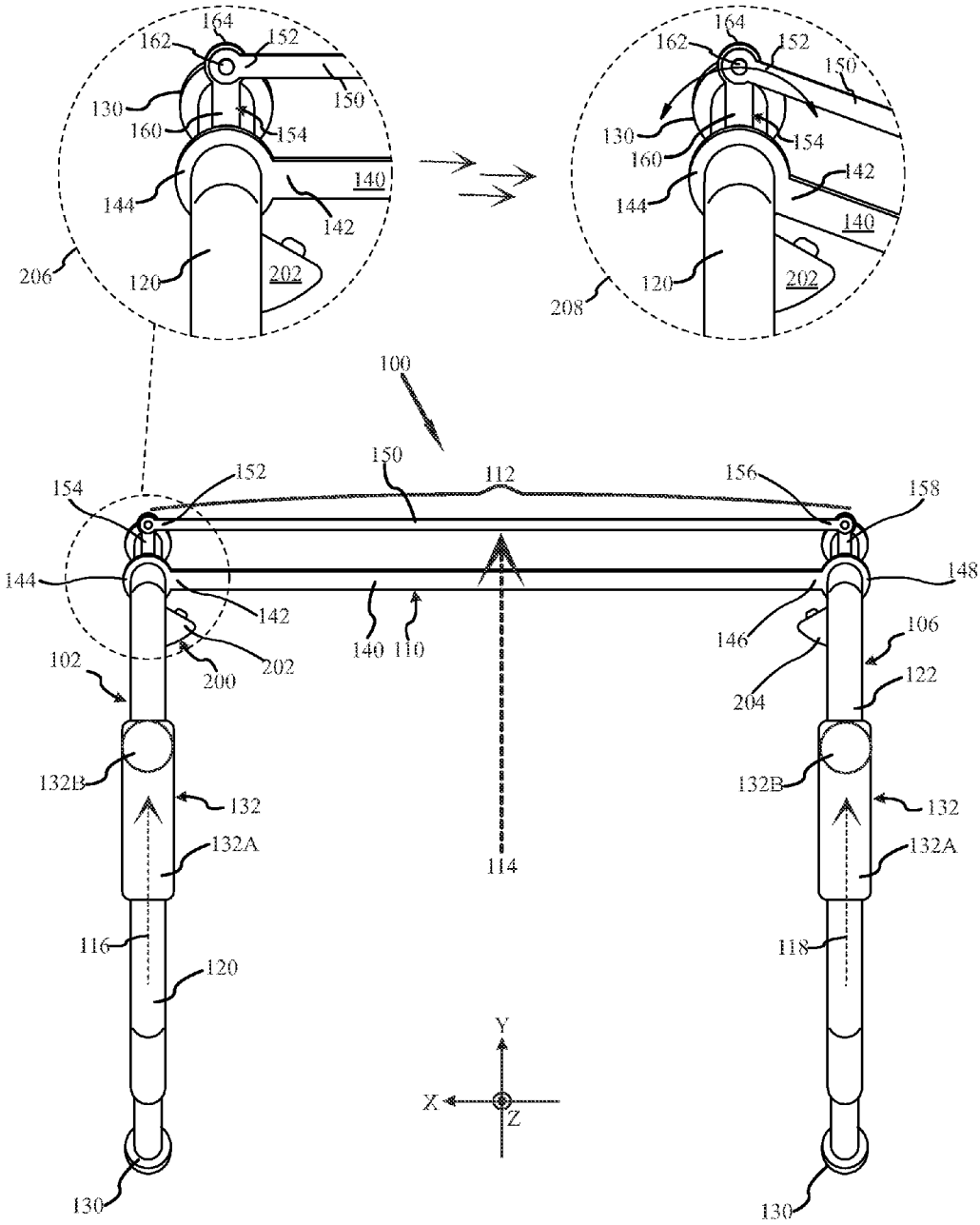
FIG. 2 is a top view of the articulating walker shown in FIG. 1.

As may be appreciated in FIGS. 1 and 2, crossbar 140, strut 150, first mount 154 and second mount 158, collectively configure as a mechanical parallelogram. A parallelogram is a convex quadrilateral structure with two pairs of parallel sides, i.e., crossbar 140 and strut 150 are parallel, and first mount 154 and second mount 158 are parallel.

The principle length of the opposing or facing elements are of equal length and the opposite angles are of equal measure. Because crossbar 140 is pivotally attached to left side frame 120 and right side frame 122, and strut 150 is pivotally attached to first mount 154 and second mount 158, the generally parallel symmetry of the left side frame 120 and the right side frame 122 is maintained as each side is alternatively moved forward.

In addition, for at least one embodiment the tolerance of the pivoting connection between the strut 150 and the first mount 154 and the second mount 158 may be biased such that an element of resistance is provided. Such resistance may in varying embodiments be adjustable. Such resistance may be desired so as to increase the stability of the articulating walker 100 as the user must actively overcome the threshold resistance to articulate either the left side frame 120 or the right side frame 122.

As shown in FIG. 2, for at least one embodiment at least one limiter 200 is provided and structure and arranged to limit the articulation of the left side frame 120 and right side frame 122 relative to the crossbar 140. More specifically, as shown, a limiter 200, such as first stopper 202 is disposed as part of the left side frame 120 proximate to the first end 142 of the crossbar 140. Likewise a limiter 200, such as second stopper 204 is disposed as part of the right side frame 122 proximate to the second end 146 of the crossbar 140.

For at least one embodiment, the first stopper 202 and second stopper 204 are formed of rubber or other material suitable to engage by contact the crossbar 140 and prevent further articulation without damage to the crossbar 140. Of course it is also understood and appreciated that the location of the first stopper 202 and second stopper 204 may be reversed, such that they are disposed upon the crossbar and arranged to engage with the left side frame 120 and right side frame 122 respectively.

Again with respect to FIG. 2, in the first enlarged portion shown by dotted line 206, the articulating walker 100 is at an initial rest position such that the left side frame 120 is generally normal to the crossbar 140 and strut 150. In the second enlarged portion shown by dotted line 208 the articulating walker 100 has articulated. The left side frame 120 has moved forward along the first direction of motion 116. The mechanical linkage of the crossbar 140, strut 150, first mount 154, and second mount 158 have operated to maintain the left side frame 120 parallel to the Y-axis, and more specifically the left side frame 120 is parallel to the right side frame 122. In addition the first stopper 202 has almost engaged the crossbar 140, and will do so at a predetermined point selected to maintain the stability of the articulating walker 100.

For at least one embodiment, when articulating walker 100 is not in use and therefore is to be stored or transported, at least one end of strut 150, e.g. first end 152, may be temporarily detached from first mount 154 such that the left side frame 120 and right side frame 122 of articulating walker 100 may be folded. Of course, in varying embodiments a temporary removal, or disengagement of the limiter 200 is also permitted to further facilitate folding for storage or transport.

Embodiments of the articulator 112 are not limited to the mechanical parallelogram as shown and described with respect to FIGS. 1 and 2. Indeed, in FIGS. 3 and 4 an alternative embodiment for the articulator 112 are shown and described wherein the articulator 112 is provided by a set of interconnected pistons.

Figure 3:
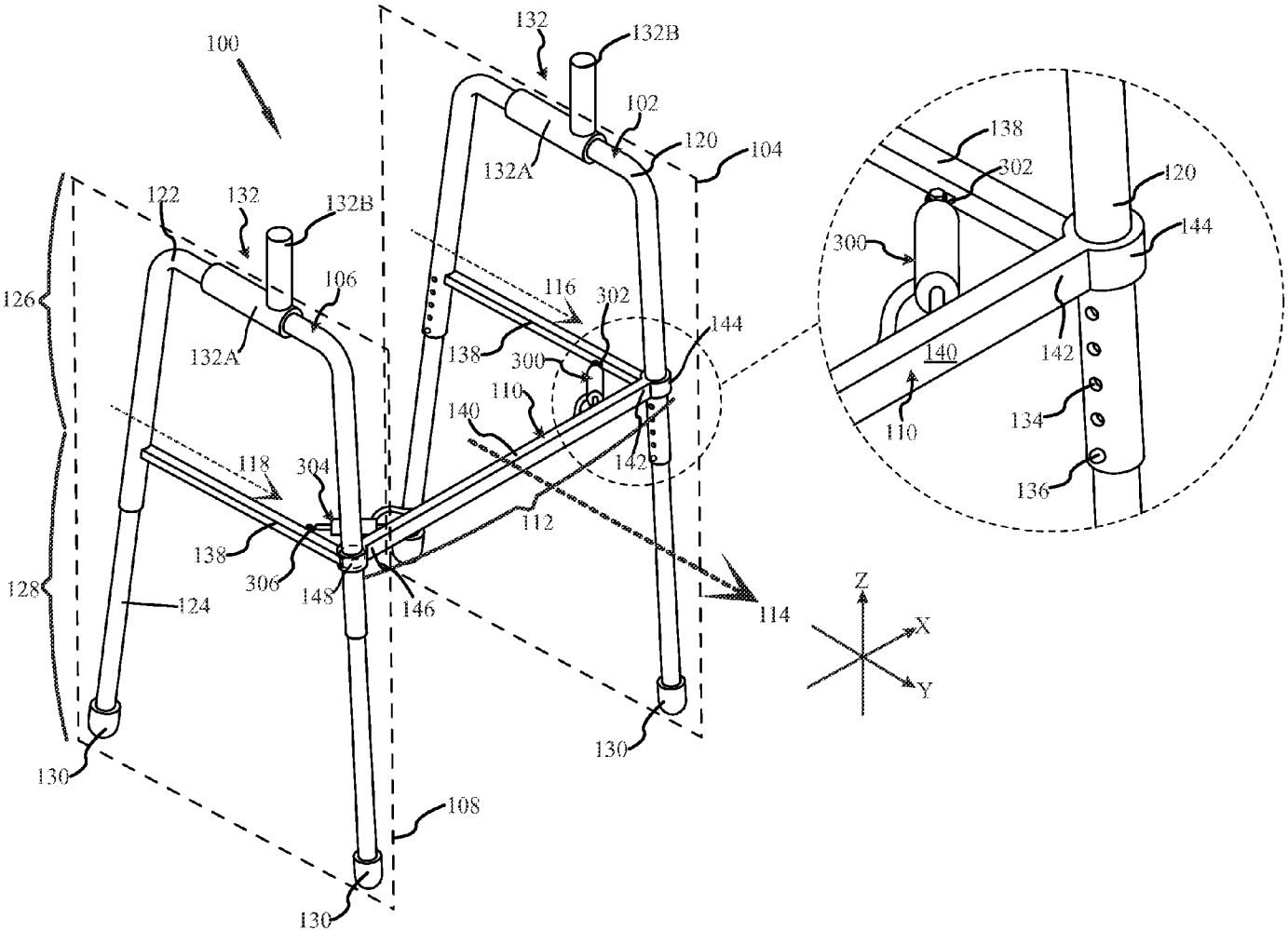
FIG. 3 is a perspective view of an articulating walker in accordance with certain embodiments of the present invention to provide an alternative articulator.

More specifically, as shown in FIG. 3 a first piston 300 is pivotally mounted between a first mount 302 provided by the first support 102, i.e. the left side frame 120, and the crossbar 140, proximate to the first end 142 of the crossbar 140. Similarly, a second piston 304 is pivotally mounted between a second mount 306 provided by the second support 106, i.e., the right side frame 122, and crossbar 140 proximate to the second end 146 of the crossbar 140.

Figure 4:
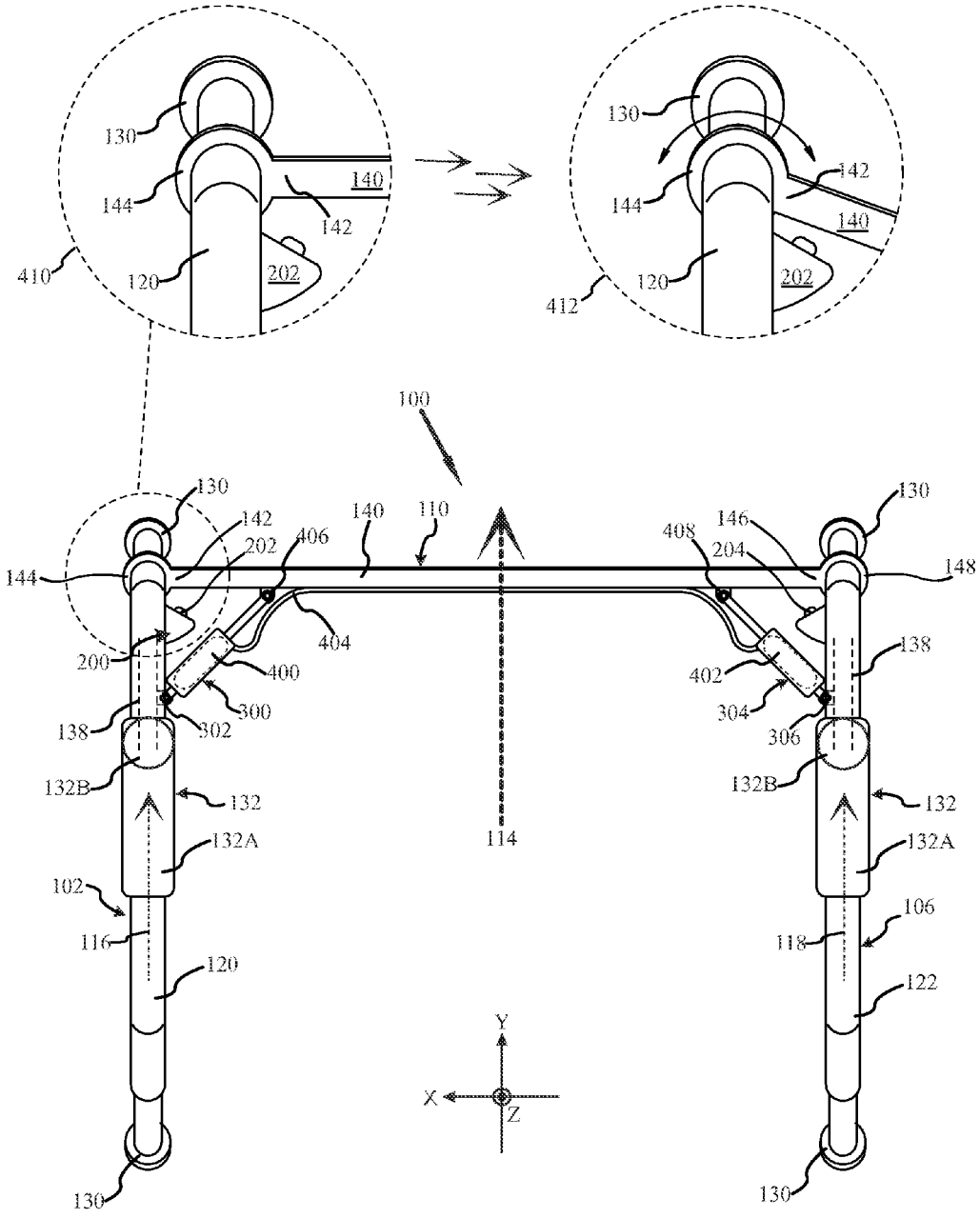
FIG. 4 is a top view of the articulating walker shown in FIG. 3.

As is more easily perceived in FIG. 4, first piston 300 has a first fluid reservoir 400, and second piston has a second fluid reservoir 402. A fluid interconnector 404, such as a hose, tube or other appropriate fluid conductor, is disposed between the first fluid reservoir 400 and the second fluid reservoir 402 permitting fluid to flow between the first fluid reservoir 400 and the second fluid reservoir 402. For at least one embodiment, the fluid is gas, and more specifically air. For at least one alternative embodiment the fluid is a liquid, and more specifically, may be a hydraulic fluid.

As may also be appreciated in FIG. 4, first piston 300 is pivotally mounted to the crossbar by a first mount 406, and likewise second piston 304 is pivotally mounted to the crossbar by a second mount 408.

For at least one embodiment, such as where the fluid is a liquid, it is understood and appreciated that the first fluid reservoir 400, second fluid reservoir 402 and fluid interconnector 404 are a closed system such that the volume of the fluid remains substantially constant. For at least one alternative embodiment, such as where the fluid is a gas, small bleed valves (not shown) may be incorporated to permit the inflow or outflow of additional gas, but in operation it is generally understood that even with these bleed vales the volume of fluid within the system is intended to be generally constant, and self leveling.

As in the illustration of FIG. 2 as described above, for at least one embodiment at least one limiter 200 is provided and structure and arranged to limit the articulation of the left side frame 120 and right side frame 122 relative to the crossbar 140. More specifically, as shown, a limiter 200, such as first stopper 202 is disposed as part of the left side frame 120 proximate to the first end 142 of the crossbar 140. Likewise a limiter 200, such as second stopper 204 is disposed as part of the right side frame 122 proximate to the second end 146 of the crossbar 140.

For at least one embodiment, the first stopper 202 and second stopper 204 are formed of rubber or other material suitable to engage by contact the crossbar 140 and prevent further articulation without damage to the crossbar 140. Of course it is also understood and appreciated that the location of the first stopper 202 and second stopper 204 may be reversed, such that they are disposed upon the crossbar and arranged to engage with the left side frame 120 and right side frame 122 respectively.

As in the case of the mechanical parallelogram as described above, the operation of the first piston 300, second piston 304 and fluid interconnector 404 is such that the generally parallel relationship between the first support 102, i.e., left side frame 120, and second support 106, e.g., right side frame 122 is maintained as they articulate about the crossbar 140.

For example, as the left side frame 120 is advanced forward along the first direction of motion 116, the first piston 300 is compressed driving fluid from the first fluid reservoir 400 through the fluid interconnector 404 into the second fluid reservoir 402. This additional fluid provided to the second fluid reservoir 402 causes the second piston 304 to expand.

As the first piston 300 and second piston 304 are symmetrically configured, the compression of one is offset by the equal expansion of the other. As such, the advantageous parallel relationship between the first support 102 and the second support 106 is maintained as the articulating walker 100 is used to facilitate a natural walking motion.

Again with respect to FIG. 4, in the first enlarged portion shown by dotted line 410, the articulating walker 100 is at an initial rest position such that the left side frame 120 is generally normal to the crossbar 140. In the second enlarged portion shown by dotted line 412 the articulating walker 100 has articulated. The left side frame 120 has moved forward along the first direction of motion 116. The interconnection of the first fluid reservoir 400 of the first piston 300 to the second fluid reservoir 402 of the second piston 304 has operated to maintain the left side frame 120 parallel to the Y-axis, and more specifically the left side frame 120 is parallel to the right side frame 122. In addition the first stopper 202 has almost engaged the crossbar 140, and will do so at a predetermined point selected to maintain the stability of the articulating walker 100.

For at least one embodiment, the interrelationship of first fluid reservoir 400 to second fluid reservoir 402 by fluid interconnector 404 is such that exchange of fluid is slowed. Such slowing therefore imparts an element of some resistance to the articulation of articulating walker 100. In varying embodiments this resistance may be adjustable. This resistance can serve to provide additional stability to articulating walker 100 as movement of either the first support 102 or the second support 106 must be initiated by the user so as to overcome the threshold of resistance.

For at least one embodiment, when articulating walker 100 is not in use and therefore is to be stored or transported, as noted above with respect to the mechanical parallelogram as shown in FIGS. 1 and 2, the articulator 112 may be at least partially disconnected. Moreover, for at least one embodiment first piston 300 and second piston 306 may be temporarily detached from at least one mount such that the left side frame 120 and right side frame 122 of articulating walker 100 may be folded. Of course, in varying embodiments a temporary removal, or disengagement of the limiter 200 is also permitted to further facilitate folding for storage or transport.

With respect the above description of the mechanical parallelogram as shown in FIGS. 1-2 and the coupled pistons as shown in FIGS. 3-4, it should be understood and appreciated that other alternative configurations for articulator 112 may also be provided. Indeed, for at least one embodiment the articulator 112 is presented as a combination involving both the strut 150 and pistons 300, 304.

Further alternative configurations for the articulator 112 may also be appreciated, such as but not limited to gears, motors, cables, springs and various combinations thereof. For example, though not shown, a worm gear may be disposed at least partially within the crossbar 140. The worm gear is meshed to a first flat gear coupled to the first support 102 at one end and a second flat gear coupled to the second support at the opposite end. Radial motion of the first gear imparts a turning force to the worm gear with a mirrored radial motion of the second gear. Reciprocating motors may also be disposed in substantially the same location and in place of the first piston 300 and second piston 304.

Figure 5:
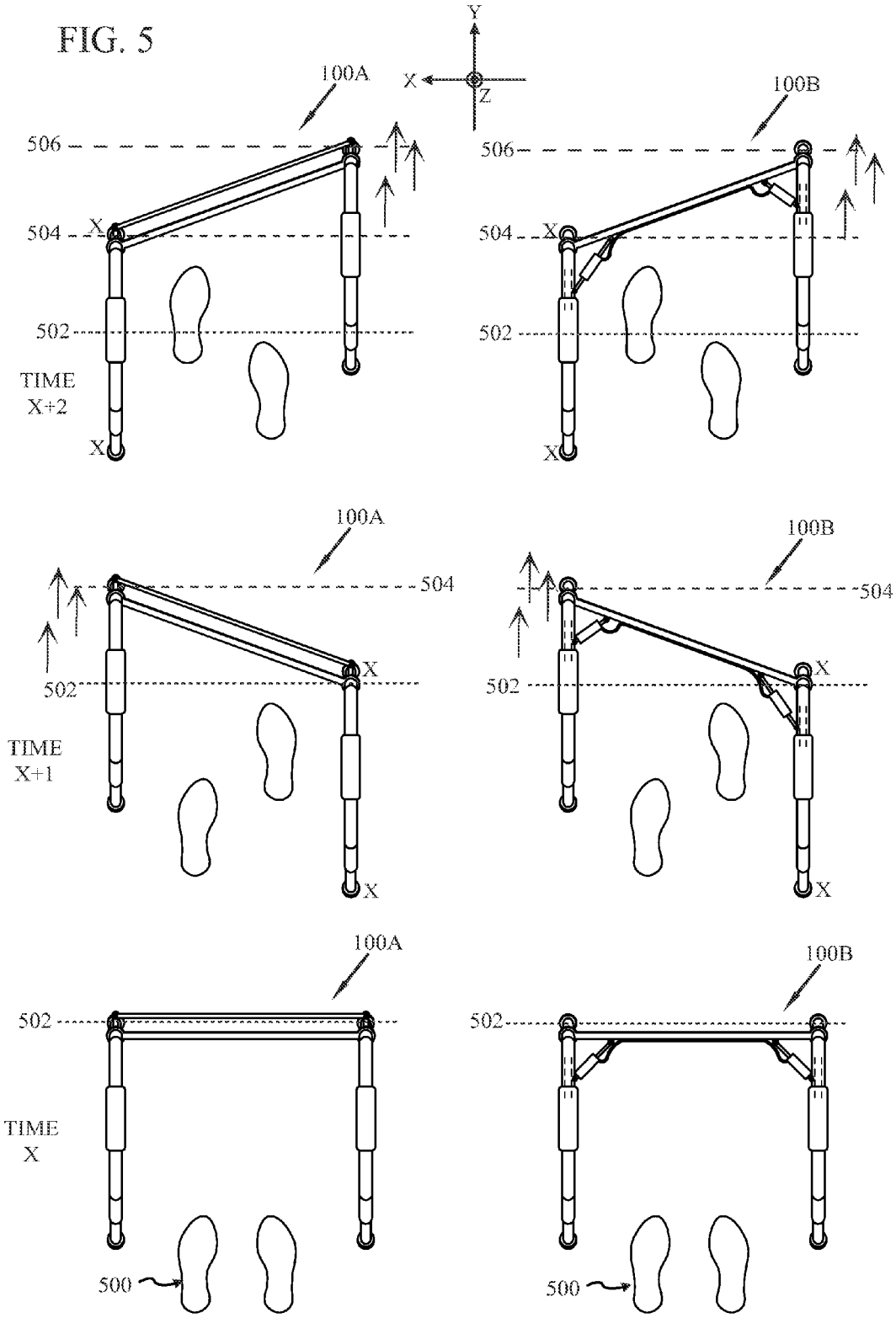
FIG. 5 is a top view conceptually illustrating the operation of the articulating walker shown in FIGS. 2 and 4.

FIG. 5 presents a top view of an articulating walker 100 in accordance with the embodiment show in FIGS. 1-2 (articulator 112 as a mechanical parallelogram—Left side, articulating walker 100A) and an articulating walker 100 in accordance with the embodiment shown in FIGS. 3-4 (articulator 112 as interconnected pistons—Right side, articulating walker 100B). Relative footsteps 500 for a user are also shown.

As shown at time value X, each articulating walker 100A, 100B is shown to be in an initial state. For each, the left side frame 120 is parallel to the right side frame 122, and each is generally normal to the crossbar 140. Crossbar 140 is also shown to be in line with initial position shown as dotted line 502.

At time value X+1, the left side frame 120 of each walker 100A, 100B has been advanced forward of the initial position 502 to second position 504. This movement of the left side frame 120 has been performed while the right side frame 122 of each walker 100A, 100B has been held stationary. As shown, the articulator 112 of each walker 100A, 100B is operating to maintain the general parallel relationship between the left side frame 120 and the right side frame 122.

At time value X+2, the right side frame 122 of each walker 100A, 100B has been advanced forward from the initial position 502, past the second position 504 to a third position 506. This movement of the right side frame 122 has been performed while the left side frame 120 of each walker 100A, 100B has been held stationary. Once again, the articulator 112 of each walker 100A, 100B is operating to maintain the general parallel relationship between the left side frame 120 and the right side frame 122 as each walker 100A, 100B advances along in the primary direction motion 114.

With respect to the footsteps 500, for time value X+1 and X+2 as shown in FIG. 5, the footsteps 500 illustrate the normal expectation of walking wherein the right foot moves opposite to the left arm—and more specifically the left side frame 120, and the left foot moves opposite to the right arm—and more specifically the right side frame 122. It is to be understood and appreciated that although the articulating walker 100 permits this natural rhythm of opposite motion, this motion is not required. Indeed, if a user so desires to move his or her left foot forward at the same time he or she is moving the left side frame 120 forward, and his or her right foot forward at the same time he or she is moving the right side frame 122 forward, he or she may certainly do so. Moreover, the articulating walker 100 advantageously permits the user to experience an articulated walking motion that he or she desires.

FIG. 6 presents yet another embodiment for articulating walker 100. In this case the first support 102 and second support 106 are again generally symmetrical, but in this case the left side frame 600 and right side frame 602 are generally "L" shaped. Moreover, unlike the generally "A" shaped frames 120, 122 above, for the embodiment of articulating walker 100 shown in FIG. 5, there is only a front vertical component 604 to each frame 600, 602.

In this configuration, each frame side 600, 602 again has an upper supporting section 126 and a base section 128. As described above, each frame 600, 602 may be generally tubular in construction and the front vertical component 604 may be adapted to permit telescoping adjustment for vertical adjustment of the horizontal grip 132A and/or vertical grip 132B.

As shown, the upper supporting section 126 has been configured for at least one embodiment as an elongated support 606 for direct contact with the ground, floor or other supporting surface.

As shown, for at least one embodiment, the telescopic adjustment is achieved for each front vertical component 604 by the use of regularly spaced buttonholes 134 set to receive a spring biased-button 136. For at least one embodiment each buttonhole 134 is about 5/16 inches in diameter. In varying embodiments, each frame 600, 602 may have one or more braces, of which brace 138 is exemplary.

In addition, for the embodiment as shown in FIG. 6, the articulator 112 is shown to be provided by the combination of the mechanical parallelogram achieved by the combination of the crossbar 140, strut 150, first mount 154, and second mount 158, as well as the use of the first piston 300, second piston 304 and fluid interconnector 404 as described above.

FIG. 7 provides yet another embodiment for articulating walker 100. In this case, the first support 102 and the second support 106 are again generally symmetrical, but in this case the left side frame 700 and right side frame 702 are generally inverted "Y" shaped.

In this configuration, each frame side 700, 702 again has an upper supporting section 126 and a base section 128. Each frame 700, 702 may again be generally tubular in construction and the generally vertical component 704 may be adapted to permit telescoping adjustment for vertical adjustment of the horizontal grip 132A and/or vertical grip 132B.

As is shown, the base section is structured and arranged to provide at least a front support 706 and a rear support 708. Moreover, for each frame side 700, 702 the front generally vertical component 704 angles rearward to provide the rear support 708. The front support 706 is provided by a bracing strut 710 that extends forward from the sloped section 712 of the generally vertical component 704.

Figure 8:
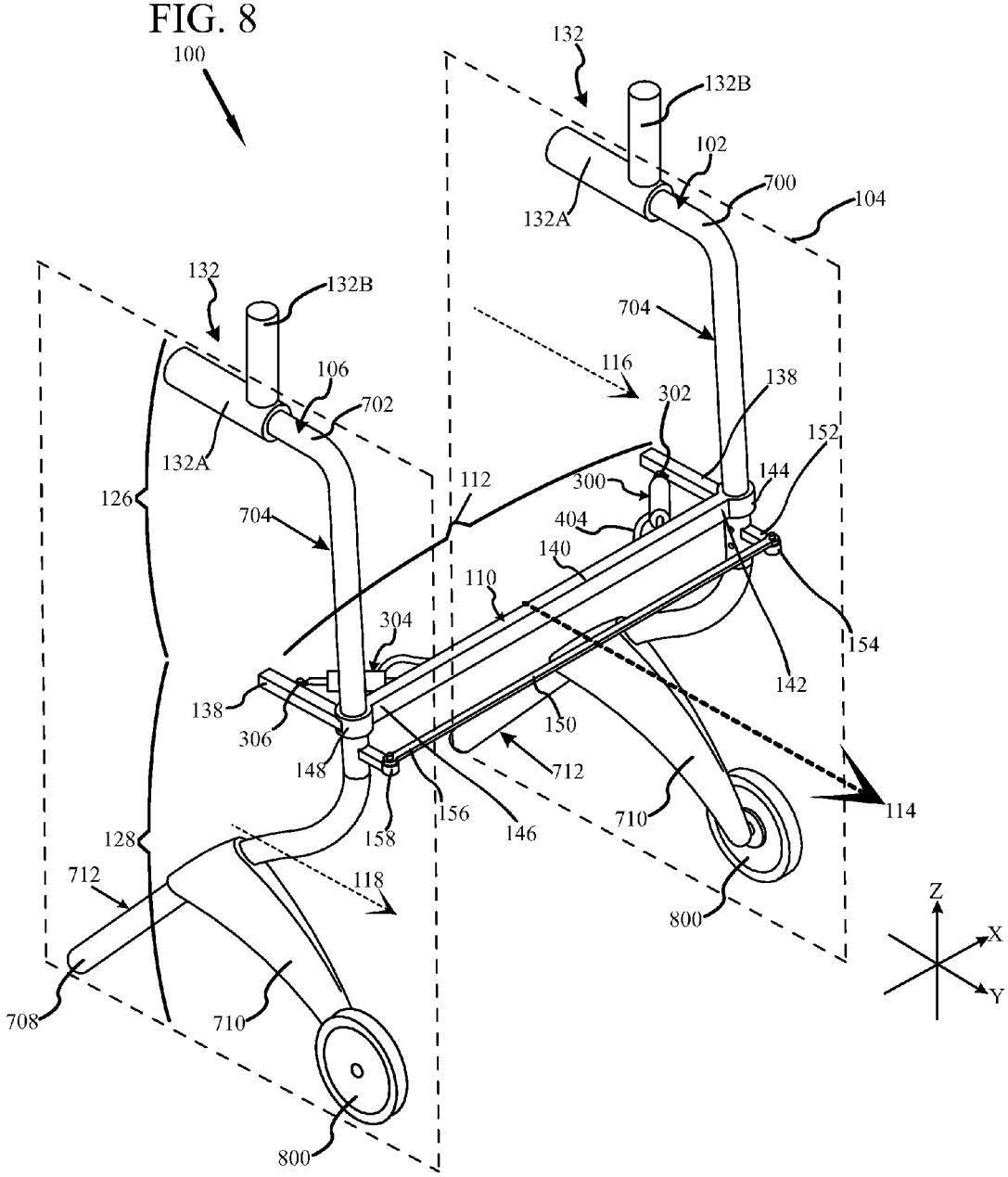
FIG. 8 is a perspective view of an articulating walker with each frame having a general inverted Y shape and optional wheels in accordance with certain embodiments of the present invention.

As shown for the embodiment presented in FIG. 6, the articulator 112 has been provided in accordance with a first piston 300, second piston 304 and fluid interconnector 404 as described above. FIG. 8 is yet another variation for an embodiment of articulating walker 100, similar to the embodiment as shown in FIG. 7 with the addition of the mechanical parallelogram achieved by the combination of the crossbar 140, strut 150, first mount 154, and second mount 158, as well as the use of the first piston 300, second piston 304 and fluid interconnector 404 as described above.

In addition, for this embodiment of articulating walker 100, the front supports 706 shown in FIG. 7 are shown in FIG. 8 as optional wheels 800. Moreover, for at least one embodiment the first support 102 and second support 106 are structured and arranged to provide at least one wheel 800 for contact with the ground. Further still, for at least one embodiment at least one wheel 800 is structured and arranged with a ratchet (not shown), such as may be found in the hub of a conventional bicycle wheel hub. The ratchet is structured and arranged so as to permit the wheel 800 to roll freely in the primary direction of motion 114 and lock when reversed.

Moreover, with respect to the above descriptions for the optional embodiments shown in FIGS. 1-8 it is understood and appreciated that the precise nature of the first support 102 and the second support 106 is not limited, but rather an articulating walker 100 may be provided in a wide range of configurations regarding the left side frame and the right side frame, as well as construction materials.

Figure 9:
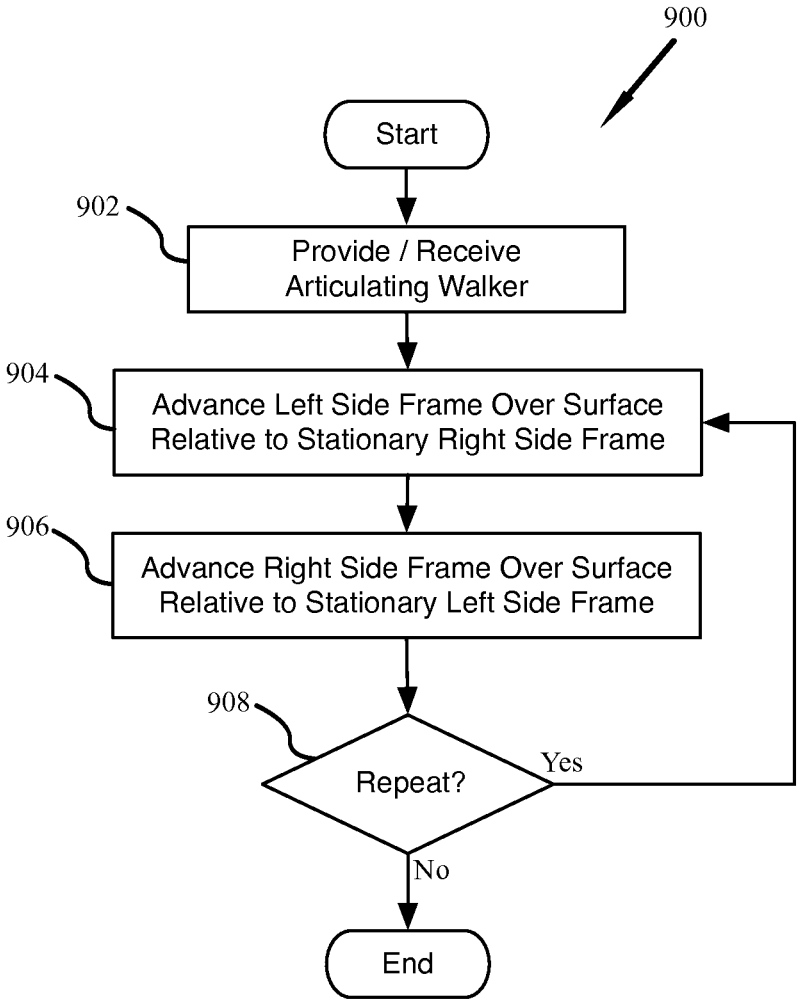
FIG. 9 is a high level flow diagram for a method of providing support and permitting a normal walking motion to a person in accordance with certain embodiments of the present invention.
Figure 11:
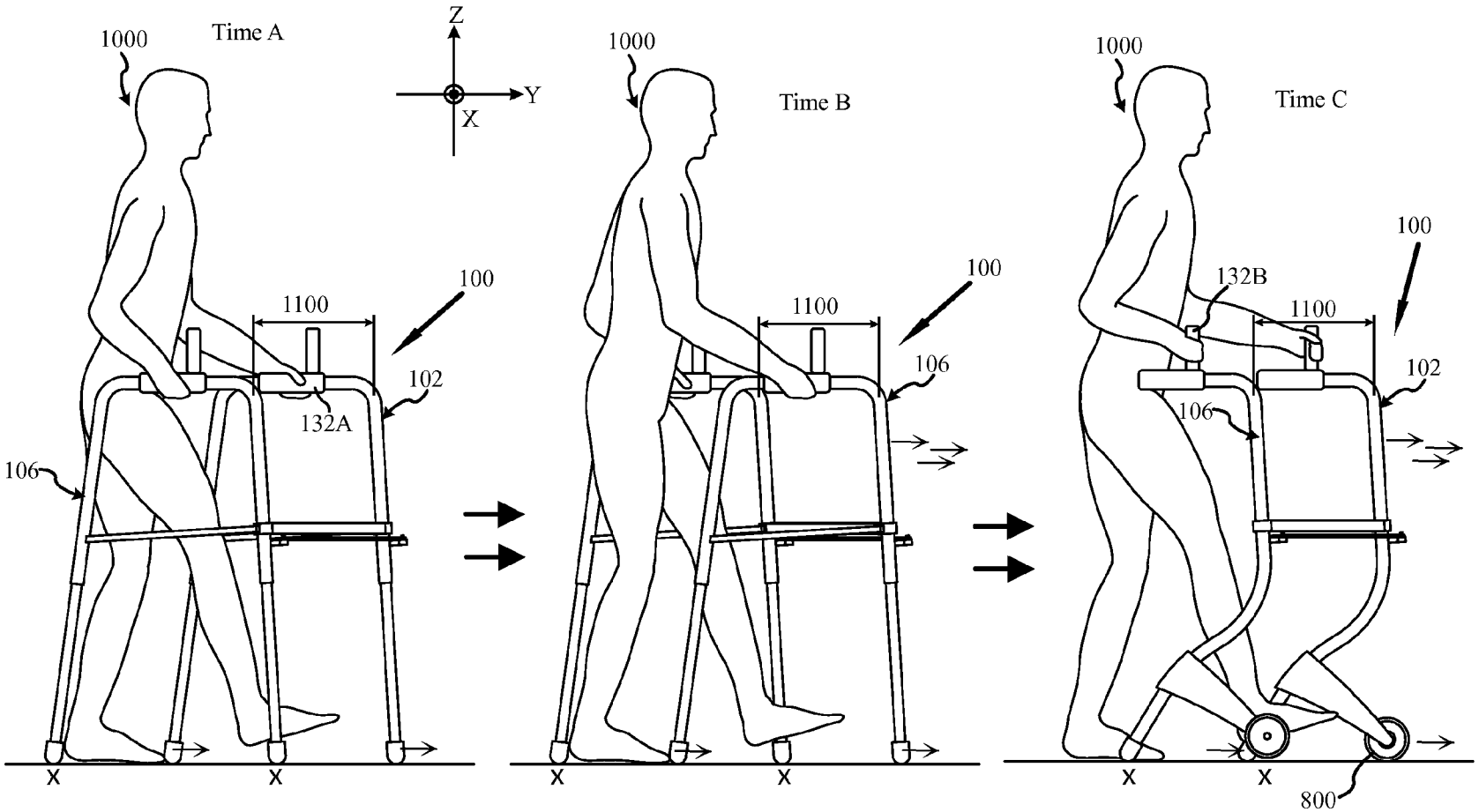
FIG. 11 is a side view of a person using an articulating walker in accordance with certain embodiments of the present invention.

FIG. 9 in connection with FIGS. 10-11 and reference to FIGS. 1-8 provides a high level flow diagram with conceptual illustrations depicting a method 900 for providing support and permitting a normal walking motion to a person. It will be appreciated that the described method need not be performed in the order in which it is herein described, but that this description is merely exemplary of one method of providing support and permitting a normal walking motion.

In general, method 900 commences by providing an articulating walker 100, block 902. As described and discussed above, for at least one embodiment the articulating walker 100 is understood to include a first support 102, e.g., left side frame 120, and a second support 106, e.g., right side frame 122. Articulating walker 100 also has at least one crossbar 140 having a first end 142 pivotally connected to the left side frame 120 and a second end 146 pivotally connected to the right side frame 122. Further, articulating walker 100 has an articulator 112 structured and arranged to maintain about a parallel relationship between the left side frame 120 and the right side frame 122 as they articulate about the crossbar 140.

For at least one embodiment the articulator 112 is structured and arranged as a mechanical parallelogram. More specifically, in at least one embodiment the articulator 112 is achieved through the combination of the crossbar 140, a strut 150, a first mount 154 and a second mount 158 as described above. For at least one alternative embodiment, the articulator 112 is structured and arranged to operate on the exchange of fluid between a first piston 300 and second piston 304 as described above. For yet another embodiment, the articulator 112 is a combination of the mechanical parallelogram and the first piston 300 and second piston 304 configuration. And for yet other embodiments, the articulator 112 is structured and arranged as a mechanical device consisting of, but not otherwise limited to, gears, motors, cables, springs and various combinations thereof.

As is shown in the perspective of FIG. 10, method 900 continues with the advancing of the left side frame 120 over a surface relative to the stationary right side frame 122, the person 1000 maintaining support on the right side frame 122, block 904. Moreover the left side frame 120 as shown has advanced to position 1002, which is a distance 1004 ahead of the right side frame 122.

Method 900 continues with the advancing of the right side frame 122 over a surface relative to the stationary left side frame 120, the person 1000 maintaining support on the left side frame 120, block 906. Moreover the right side frame 122 as shown has advanced to position 1006, which is a distance 1008 ahead of the right side frame 122.

As indicated by decision 908, method 900, and more specifically blocks 904 and 906 may be repeated.

FIG. 11 presents a series of side views of the articulating use of articulating walker 100 to more fully appreciate the respective motion of the first support 102 and the second support 106 as the person 1000 uses articulating walker 100. As shown, there is a general linear distance 1100 between the articulated first support 102 and second support 106. In addition, for Time events A and B, the person 1000 is shown using the horizontal grips 132A of the articulating walker 100, whereas for Time event C, the person is shown using the vertical grips 132B of the articulating walker 100, which is also shown to have optional wheels 800. In each illustration arrows are provided to indicate motion of one side, and "X" marks have been provided to indicate no motion.

Moreover with respect to FIGS. 10-11 especially, it should be apparent that articulating walker 100 permits a user to enjoy a substantially normal walking rhythm that does not require the walker to be picked up or shoved forward as is the traditional practice with a non-articulating walker. It should also be appreciated that the pivoting connections between the interconnector 110, first support 102 and second support 106 may in certain embodiments permit at least a limited range of independent vertical motion as well. As such, at least one embodiment of articulating walker 100 may be advantageously suitable to assist in a natural walking motion up or down stairs.

It is to be understood that changes may be made in the above methods, systems and structures without departing from the scope hereof. It should thus be noted that the matter contained in the above description and/or shown in the accompanying drawings should be interpreted as illustrative and not in a limiting sense. The following claims are intended to cover all generic and specific features described herein, as well as all statements of the scope of the present method, system and structure, which, as a matter of language, might be said to fall therebetween.

What is claimed is:

1. An articulating walker, comprising:

a generally vertical first support in a first plane;

a generally vertical second support in a second plane generally parallel to the first plane;

an interconnector pivotally attached between the first support and the second support, the interconnector provided by at least one crossbar having a first end having a first pivot joint and opposite thereto a second pivot joint, the first pivot joint connecting the first support to the crossbar, the second pivot joint connecting the second support to the crossbar; and an articulator structured and arranged to maintain the generally parallel relationship between the first plane and the second plane as the first support and second support move relative to each other about the interconnector, the articulator provided by;

a first piston pivotally mounted between a first mount provided by the first support and the crossbar proximate to the first end of the crossbar, the first piston having a first fluid reservoir;

a second piston pivotally mounted between a second mount provided by the second support and the crossbar proximate to the second end of the crossbar, the second piston having a second fluid reservoir; and a fluid interconnector disposed between the first reservoir and the second reservoir permitting a fluid to flow between the first reservoir and the second reservoir.

2. The articulating walker of claim 1, wherein the articulator further comprises a strut parallel to and offset from the crossbar, the strut having a first end pivotally connected to a first mount provided by the first support, and a second end pivotally connected to a second mount provided by the second support.

3. An articulating walker, comprising:

a left side frame;

a right side frame;

a crossbar having a first end pivotally connected to the left side frame and a second end pivotally connected to the right side frame; and an articulator structured and arranged to maintain about a parallel relationship between the left side frame and the right side frame as they articulate about the crossbar, the articulator provided by;

a first piston pivotally mounted between a first mount provided by the left side frame and the crossbar proximate to the first end of the crossbar, the first piston having a first fluid reservoir;

a second piston pivotally mounted between a second mount provided by the right side frame and the crossbar proximate to the second end of the crossbar, the second piston having a second fluid reservoir; and a fluid interconnector disposed between the first reservoir and the second reservoir permitting a fluid to flow between the first reservoir and the second reservoir.

4. The articulating walker of claim 3, wherein each side frame has an upper supporting section and a base section, the upper section providing at least one grip allowing a user to grasp the frame for assisted support when walking or standing, the base section structured and arranged for stable contact on a surface when the user is walking or standing.

5. The articulating walker of claim 4, wherein each frame is generally of an A shape configuration.

6. The articulating walker of claim 4, wherein each frame is generally of an L shape configuration.

7. The articulating walker of claim 4, wherein each frame is generally of an inverted Y shape configuration.

8. The articulating walker of claim 4, wherein for a first instance each frame provides a horizontal grip, for a second instance each frame provides a vertical grip, and for a third instance each frame provides both a horizontal and vertical grip.

9. The articulating walker of claim 3, wherein the articulator further comprises a strut parallel to and offset from the crossbar, the strut having a first end pivotally connected to a first mount provided by the left side frame, and a second end pivotally connected to a second mount provided by the right side frame.

10. The articulating walker of claim 3, wherein the fluid is air.

11. The articulating walker of claim 3, wherein the fluid is hydraulic fluid.

12. The articulating walker of claim 3, further including a limiter structured and arranged to limit articulation of the left side and right side relative to the crossbar.

13. The articulating walker of claim 12, wherein the limiter further includes a first stopper affixed to the crossbar proximate to the first end and aligned to engage the left sidebar at a predetermined angle and a second stopper affixed to the crossbar proximate to the second end and aligned to engage the right sidebar at a predetermined angle.

14. The articulating walker of claim 12, wherein the limiter further includes a first stopper affixed to the left side frame proximate to the first end of the crossbar and a second stopper affixed to the right side frame proximate to the second end of the crossbar.

15. The articulating walker of claim 3, wherein the left side frame has at least one wheel and the right side frame has at least one wheel.

16. The articulating walker of claim 15, wherein the wheels are structured and arranged to roll in a first direction and lock in a second direction.

17. A method of providing support and permitting a normal walking motion to a person comprising:

providing an articulating walker comprising;

a left side frame;

a right side frame;

a crossbar having a first end pivotally connected to the left side frame and a second end pivotally connected to the right side frame; and an articulator structured and arranged to maintain about a parallel relationship between the left side frame and the right side frame as they articulate about the crossbar, the articulator provided by;

a first piston pivotally mounted between a first mount provided by the left side frame and the crossbar proximate to the first end of the crossbar, the first piston having a first fluid reservoir;

a second piston pivotally mounted between a second mount provided by the right side frame and the crossbar proximate to the second end of the crossbar, the second piston having a second fluid reservoir; and a fluid interconnector disposed between the first reservoir and the second reservoir permitting a fluid to flow between the first reservoir and the second reservoir;

advancing the left side frame over a surface relative to the stationary right side frame, the person maintaining support on the right side frame; and advancing the right side frame over the surface relative to the stationary left side frame, the person maintaining support on the left side frame.

18. The method of providing support and permitting a normal walking motion of claim 17, wherein the person moves his or her left foot about contemporaneously with the advancing of the right side frame and moves his or her right foot about contemporaneously with the advancing of the left side frame.

19. The method of providing support and permitting a normal walking motion of claim 17, wherein the person moves his or her left foot about contemporaneously with the advancing of the left side frame and moves his or her right foot about contemporaneously with the advancing of the right side frame.

20. The method of providing support and permitting a normal walking motion of claim 17, wherein the left side frame has at least one wheel and the right side frame has at least one wheel.

21. The method of providing support and permitting a normal walking motion of claim 20, wherein the wheels are structured and arranged to roll in a first direction and lock in a second direction.

* * * * *